US012297702B2

(12) United States Patent
Nguyen et al.

(10) Patent No.: US 12,297,702 B2
(45) Date of Patent: May 13, 2025

(54) HOISTING SYSTEM AND METHOD OF OPERATING A HOISTING SYSTEM

(71) Applicant: Engineered Custom Solutions, LLC, Houston, TX (US)

(72) Inventors: Chau Nguyen, Katy, TX (US); David Hill Swasey, Brookshire, TX (US); Rick Evan Baskin, Magnolia, TX (US); Chris Licatovich, Cypress, TX (US); Christian Leuchtenberg, Singapore (SG)

(73) Assignee: ENGINEERED CUSTOM SOLUTIONS, LLC, Houston, TX (US)

( * ) Notice: Subject to any disclaimer, the term of this patent is extended or adjusted under 35 U.S.C. 154(b) by 0 days.

(21) Appl. No.: 18/352,533

(22) Filed: Jul. 14, 2023

(65) Prior Publication Data

US 2024/0018832 A1 Jan. 18, 2024

Related U.S. Application Data

(60) Provisional application No. 63/389,167, filed on Jul. 14, 2022.

(51) Int. Cl.
*E21B 19/06* (2006.01)
*E21B 19/16* (2006.01)

(52) U.S. Cl.
CPC ..... *E21B 19/06* (2013.01); *E21B 19/16* (2013.01)

(58) Field of Classification Search
CPC ..... E21B 19/06; E21B 19/16
See application file for complete search history.

(56) References Cited

U.S. PATENT DOCUMENTS

| | | | | |
|---|---|---|---|---|
| 2,719,747 | A | 10/1955 | Layne | |
| 4,943,188 | A * | 7/1990 | Peppel | B63B 21/502 114/294 |
| 6,109,587 | A | 8/2000 | Peacock et al. | |
| 9,932,785 | B2 * | 4/2018 | Frith | E21B 19/24 |
| 11,473,386 | B2 * | 10/2022 | Pliska | E21B 33/03 |

FOREIGN PATENT DOCUMENTS

| | | | |
|---|---|---|---|
| AU | 2018212298 | A1 | 9/2019 |
| EP | 2 347 067 | B1 | 7/2016 |
| WO | WO 2018/139931 | A1 | 8/2018 |

OTHER PUBLICATIONS

International Search Report and Written Opinion dated Nov. 7, 2023 (12 pages) from PCT Priority Application PCT/GB2023/051857.

* cited by examiner

*Primary Examiner* — Matthew R Buck
(74) *Attorney, Agent, or Firm* — Crowell & Moring LLP

(57) ABSTRACT

A hoisting system including a hoisting apparatus and a connector. The connector including a first part and a second part, one of which is suspended from the hoisting apparatus and the other secured to the load. Each of the first and second parts includes corresponding curved surface that enclose a cylindrical volume. The curved surface of the second part being coaxial but spaced from one another, wherein one of the first part or the second part is provided with a plurality of pins which are spaced around a circumference of and extend radially from the curved surface of the one of the first part or the second part. The curved surface of the other one of the first part or the second part is provided with an indexing channel and a plurality of entry channels.

20 Claims, 12 Drawing Sheets

A
2
6a
6b
14
6d
1
10c
20a
4a
9
21a
20b
10a
21b
21c
4b
10b
10c
20d
A
10d
20e
10e
10g
20g
21f
20f
9
4
8
21e
21d
10f

A
7a
2
6b
6a
1
7b
4a
4
9
8
4b
8b
8a
8c

70

41
4''
72
2''
70

100
101
4''
70

101
41
4''
70

4'''''''
4''''''
4'''''
4''''
4'''
4''
4'
8
9
114
116

HOISTING SYSTEM AND METHOD OF OPERATING A HOISTING SYSTEM

This application claims priority from U.S. Provisional Application No. 63/389,167, filed on Jul. 14, 2022, the entire contents of which is incorporated herein by reference in its entirety.

BACKGROUND OF THE INVENTION

Field of the Invention

This invention relates to a hoisting system suitable for use in general for load handling. The hoisting system includes a connector which can be attached to a hoist such as a drilling derrick, a crane or other apparatus for vertical reciprocating lifting of an object that needs to be moved, by engaging with the object and then disengaging with the object. More specifically, embodiments of the present disclosure are disclosed that can be used to i) install and retrieve a rotating control device (RCD) on a drilling rig; ii) install and retrieve a drilling or completion tool in a wellbore; and iii) lift objects with a crane, hoist or other means of vertical reciprocating means that can then move the object to a different location.

Description of Related Art

The traditional and most common method of attaching loads to a hoist is by means of a hook that is part of the hoisting system onto which slings or shackles are attached which are connected to the load, i.e., the object to be hoisted. The attachment of the load to the hook has been a traditionally manual intervention with all the risks associated with such interaction by a person that is a great cause of accidents. There are many prior art inventions for reducing this manual interaction and they can be specific to the load or more general in application. Most of them still require a degree of precision in directing the attachment end of the hoist, usually a hook or latch close to the engagement section of the load which can be a sling, shackle, or a pad-eye.

There are many prior art systems that have self-engaging hooks for hoist and remote releasable mechanisms for the hooks that can be by a tag line, battery operated with a wireless transmitter, etc., too numerous to detail here. While the concept of remote releasing a load from a hook or latch is well established, most of these systems still require significant precision by the operator of the hoist to position the hook or latching device close to the lifting point of the load.

It is an object of the present invention to provide an alternative connector for connecting a lifting apparatus to a load to be lifted which may facilitate quicker and/or safer connecting of the lifting apparatus to the load.

SUMMARY

According to one embodiment we provide a hoisting system including a hoisting apparatus which is operable to lift a load, and a connector by means of which the load can be releasably connected to hoisting apparatus, the connector including a first part and a second part, one of which is suspended from the hoisting apparatus and the other of which configured to be secured to the load, each part having a curved surface which encloses a generally cylindrical volume with a longitudinal axis, the curved surface of the first part being an interior surface, and the curved surface of the second part being an exterior surface, and the diameter of the curved surface of the second part being less than the diameter of the curved surface of the first part, so that the second part can be placed inside the first part with the two curved surfaces coaxial but spaced from one another, wherein one of the first part or the second part is provided with a plurality of pins which are spaced around the circumference of and extend radially from the curved surface, and the curved surface of other one of the first part or the second part is provided with at least one indexing channel which extends around at least a portion of the circumference of the curved surface and a plurality of entry channels—one for each pin, each entry channel extending from the curved surface at a first end of the curved surface on which is it provided to the or one of the indexing channel(s).

The curved surface of whichever of the first or second part is provided with the entry channels may have a second end, the curved surface extending from the first end to the second end. In this case, if whichever of the first or second part is provided with the entry channels is suspended from the hoisting apparatus, the first end is below the second end.

The system may further include a load and whichever of the first or second part is provided with the entry channels is secured to the load, the load and the respective part of the connector being arranged such that the first end is vertically above the second end.

One or both of the first and second parts may be connected to either the hoisting apparatus or the load with a connection which is configured to permit the respective first or second part to rotate about its longitudinal axis.

The length of the pins and the depth of the indexing and entry channels may be such that the first part can only be placed inside or removed from the second part when each of the engagement pins extends into one of the entry channels, or the or one of the indexing channel(s).

The angle between adjacent entry channels may be the same as the angle between adjacent pins.

The or each indexing channel may have first and second edges, the edges of the or each indexing channel forming a plurality of camming surfaces each of which are inclined relative to the longitudinal axis at an angle of less than 90°.

The curved surface of whichever of the first or second part is provided with the indexing channels may have a second end, the curved surface extending from the first end to the second end, the first edge of the or each indexing channel being closer to the first end of the curved surface on which it is provided than the second edge, and the first edge may be configured to form a plurality of camming surfaces which extend towards the first end when moving in a first direction around the circumference of the curved surface, and the second edge of the or each indexing channel be configured to form a plurality of camming surfaces which extend towards the second end when moving in the first direction around the circumference of the curved surface.

In one embodiment, the curved surface of whichever of the first or second part is provided with the indexing channels has a second end, the curved surface extending from the first end to the second end, the first edge of the or each indexing channel being closer to the first end of the curved surface on which it is provided than the second edge, wherein the first edge of the indexing channel is provided with a rest formation where the first edge transitions from extending towards the first end to extending towards the second end.

In one embodiment the curved surface of whichever of the first or second part is provided with the indexing channels has a second end, the curved surface extending from the first end to the second end, the first edge of the or each indexing channel being closer to the first end of the curved surface on which it is provided than the second edge, wherein the second edge of the indexing channel is provided with a rest formation where the second edge transitions from extending towards the second end to extending towards the first end.

In one embodiment the connector is provided with a single indexing channel which extends in a loop around the entire circumference of whichever of the first or second part on which it is provided.

In one embodiment the system further includes a plurality of flexible cables which are connected to whichever of the first or second parts of the connector is configured to be secured to the load, and which are provided with a releasable attachment part by means of which the flexible cables can be secured to the load.

According to second embodiment we provide a method of operating a hoisting system as specified above to lift a load, the method includes securing whichever of the first or second parts of the connector is not suspended from the hoisting apparatus to the load, and operating the hoisting apparatus to:

a) suspend whichever part of the connector is suspended from the hoisting apparatus vertically above the other part of the connector,
b) move whichever part of the connector is suspended from the hoisting apparatus downwardly so that the second part of the connector enters the first part of the connector and the two parts of the connector are connected,
c) move whichever part of the connector is suspended from the hoisting apparatus upwardly to lift the load,
d) move whichever part of the connector is suspended from the hoisting apparatus downwardly until the load comes to rest on a supporting surface,
e) move whichever part of the connector is suspended from the hoisting apparatus downwardly and then upwardly to disconnect and separate the two parts of the connector.

In one embodiment one or both of the first and second parts of the connector are mounted on the hoisting apparatus or load such that the first and/or second part can rotate about its longitudinal axis relative to the hoisting apparatus or load, the or each indexing surface has a first edge and a second edge, the first edge being closer to the first end of the curved surface than the second edge, and the method comprises, during step b engaging the engagement pins with a camming surface provided on a second edge of the or one of the indexing channel(s) so that engagement of the engagement pins with the camming surfaces causes one or both of the first and/or second parts to rotate about its longitudinal axis.

In one embodiment the method additionally includes, during step c, engaging the engagement pins with a camming surface provided on a first edge of the or one of the indexing channel(s) so that engagement of the engagement pins with the camming surfaces causes one or both of the first and/or second parts to rotate about its longitudinal axis.

In one embodiment the method additionally includes, during step e, during the downward movement, engaging the engagement pins with a further camming surface provided on the second edge of the or one of the indexing channel(s) so that engagement of the engagement pins with the camming surfaces causes one or both of the first and/or second parts to rotate about its longitudinal axis.

In one embodiment the method additionally includes, during step e, during the upward movement, engaging the engagement pins with a further camming surface provided on the first edge of the or one of the indexing channel(s) so that engagement of the engagement pins with the camming surfaces causes one or both of the first and/or second parts to rotate about its longitudinal axis.

According to another embodiment we provide a method of lifting a load using a hoisting system specified above wherein the load is a block, the first part of the connector is embedded in the block, and the second part of the connector is suspended from the hoisting apparatus operating the hoisting apparatus to:

a) suspend the second part of the connector vertically above the first of the connector,
b) move the second part of the connector downwardly so that it enters the first part of the connector and the two parts of the connector are connected,
c) move the second part of the connector upwardly to lift the load,
d) move the second part of the connector downwardly until the load comes to rest on a supporting surface,
e) move the second part of the connector downwardly and then upwardly to disconnect and separate the two parts of the connector.

A method of landing a tool in or on a wellbore using a hoisting system, wherein the first part of the connector is mounted around a tubular suspended from the hoisting apparatus, and the second part of the connector is mounted on the tool, and operating the hoisting apparatus to:

a) suspend the first part of the connector vertically above the second part of the connector,
b) move the tubular of the connector downwardly so that the second part of the connector enters the first part and the two parts of the connector are connected,
c) move the tubular upwardly to lift the tool,
d) move the tubular downwardly until the tool comes to rest on a landing formation in or on the wellbore,
e) move the tubular downwardly and then upwardly to disconnect and separate the two parts of the connector.

A quick connector is disclosed that can be used for the vertical engagement or dis-engagement from a hoist, crane or overhead travelling block. Any system that enables vertical reciprocation can use this quick connector. E.g., a hydraulic, electric or air actuated vertical lifting system like a hydraulic cylinder can be used. It is also possible to use the mechanism in a horizontal plane if the load is balanced. The core mechanism includes pins moving inside continuous cam surfaces that alternatively locks and unlocks the quick connector. The design is very versatile as the mechanism can be designed with the following main variations:

i) Cam surfaces external on lower external indexing sleeve and upper internal engagement sleeve with engagement pins internal to this sleeve fitting over lower indexing sleeve—STANDARD mechanism
ii) Engagement pins protruding externally from lower external engagement sleeve and upper inner indexing sleeve with cam surfaces internal to this sleeve—REVERSE mechanism
iii) Cam surfaces internal on lower internal indexing sleeve and upper external engagement sleeve that fits inside the lower sleeve—INTERNAL mechanism
iv) Engagement pins protruding internally from lower internal engagement sleeve and upper external indexing sleeve with cam surfaces external on this sleeve that fits inside the lower internal engagement sleeve INVERTED STANDARD mechanism The quick connector can be solid at the core or the core can be hollow enabling the passage of fluids an advantageous feature of the design as disclosed for wellbore operations.

One end of the quick connector needs to rotate as either the cam surfaces move up and down or the engagement pins move up and down. The quick connector can be designed with a minimum of 2 engagement pins and 2 open cam slots spaced 180 degrees apart, which would enable the tool to engage by pushing down and rotating by 45 degrees one end of the quick connector (either upper or lower). In this position a load can be applied to ensure that full travel has occurred. Then on a pull up cycle a further rotation of 45 degrees occurs and the quick connector would be locked and full load can be applied. Then to disengage a down push rotates one part of the connector by a further 45 degrees and a load can be applied to ensure this cycle has been completed. To disconnect an upward pull is applied which now allows the engagement pins to aligned with the open part of the cam, completing a 180 degree cycle and the quick connector is dis-engaged. Thus, each cycle from open to open is four strokes: 1. Down, 2. Up, "engaged" 3. Down, 4. Up "dis-engaged."

The indexing cam surfaces can be arranged such that the rotation is clockwise or anti-clock wise for each of the variations (standard, reverse, internal, inverted standard) described above. The description of the embodiments will use a four-pin engagement system with each full cycle (down, up, down, up) rotating by 90 degrees either the lower or upper part of the quick connector. A swivel or ability to swivel must be part of the design. Usually, the hook of the hoist engaging with the quick connector will have a swivel.

To increase the load capacity or for larger diameter inner bore requirements more engagement pins can be added, e.g., 6, 8, 12 or more engagement pins that will rotate the indexing sleeve by 60°, 45°, 30° or less. The more engagement pins the greater the load capacity, assuming the same diameter of pins.

The engagement pins will typically be circular in shape. They can have convex or concave surfaces to match the diameter of the travel cam surface. The engagement pins can be set in bearings or even be bearings to reduce friction when travelling in the cam. The engagement pins can be rigidly affixed to the engagement sleeve or they may be sprung loaded with springs and free to move in a radially horizontal plane.

The engagement of the quick connector, being an advantageously hands-free operation can be enhanced by guides, funnels, chamfers or other types of self-guiding aids to enhance the performance of this hands-free engagement characteristic. These guides can be affixed to either end or both of the variations (standard, reverse, internal, inverted standard) described above. This hands-free engagement characteristic also enables the hands-free disengagement of the connector. The guide, funnel, chamfer or other type of self-guide can be part of the design of the lifted object as will be disclosed in embodiments for lifting concrete tetrapods for seawall construction.

The upper or lower part of any of the quick connector variations disclosed can have a spring that is vertically compressed or decompressed as required to aid in the disconnection of the quick disconnector to enhance the hands-free operability of the design.

The engagement pins can be different from circular and have angles or be shaped as a triangle or rhombus or other such shape that may be advantageous for movement in the cam slots. The cam slots can have different angles for down and up strokes suited to the lifting application.

One significant feature of the design is to provide effective entry of engagement pins into the working path of the guide body without inadvertent entry into the exit path.

Similarly, the engagement pins will automatically find the exit path.

The number of engagement pins can be less by half or more of the cam entry/exit slots.

According to a first embodiment, a quick connector assembly of the standard type is disclosed for setting and retrieving a rotating control device.

According to a second embodiment, a quick connector assembly of the reverse type is disclosed.

According to a third embodiment, a quick connector assembly of the internal type is disclosed.

According to a fourth embodiment, an application of the internal quick disconnector for handling large concrete blocks is disclosed. This embodiment discloses the use of a spring to aid disconnection.

According to a fifth embodiment, an application of the standard quick connector with a funnel guide for a four-point lifting sling is disclosed.

According to a sixth embodiment, an application of the reverse quick connector with a funnel guide for a four-point attachment is disclosed.

Variations of the engagement pins, cam slots and face profiles of the pins are disclosed.

This invention and its embodiments will disclose a self-latching and self-unlatching mechanism that requires no direct human intervention. Furthermore, embodiments of this invention termed a "quick connector" are able to require significantly less precision for attaching to the load/object which will enable more efficiency in the hoisting process.

The various implementations possible of the inventive idea have a broad application and this will be illustrated with various embodiments. In particular the disclosed mechanism is useful for repeated install/de-install action like that for a rotating control device on a drilling rig.

Also, any object that needs to be repetitively lifted moved and placed as is common in manufacturing plants would be an application. The quick connector will improve efficiency for hoisting applications where the hoist has to swing, boom or traverse by requiring less precision for engagement with enhancements disclosed. Incumbent hoisting solutions such as those marketed by companies listed below, typically use some sort of hook release solution:

Caldwell-Rig Release—remote tag line release of hook
Elibia-Evo—wireless release systems from hook
Pewag-Levo—wireless release system from hook
Gigasense—gravity release hook
OTT—gravity release mechanism All have the common interface of a hook which requires precision from the crane to engage with a sling or a lifting point. Typically, all of them would be an addition to the main hook of a crane or hoist to enable remote engagement or release of the load. While easier than a normal hook with less manual intervention they do not have the same attributes of the disclosed inventive idea.

There will be significant improvement in the safety of attaching and removing loads in difficult environments like offshore supply and recovery where on and offloading cargo from supply vessels that are subject to heave is a risky operation. The inventive quick connector will enable these risky engagements of load and disengagement of load to be done hands-free with no human intervention.

Similarly, where loads are place in risky or difficult environments the removal of persons from engaging and disengaging the load are a significant improvement in safety. Two examples for this are: i) placing or removing concrete barrier blocks that are used for lane separation during highway repair can be done efficiently and safely without human interaction at the lifting point on the blocks and ii) placing seawall (breakwater) concrete or steel blocks which are typically tetrapods. These tetrapods are placed into patterns both regular and irregular at the wave break zone. This is a very difficult location in terms of terrain if tetrapods are already in place as well as risky in terms of wave action. A self-releasable mechanism as disclosed with the quick connector in a particular embodiment will make this a much safer operation.

The mechanism of the quick connector enables easy load calculations for the capacity including safety margins to be made. The design can be implemented in a variety of embodiments to optimize the performance for the task at hand. The design can be cost-effectively mass produced.

In summary the Quick Connector disclosed will enable: i) hands-free engagement; ii) hands-free disengagement; iii) impossibility to disconnect under load; iv) rapid en- and dis-engagement; v) requires less precision than a hook (enhanced or not) for engagement of the load.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTIONS

Figure 1B:
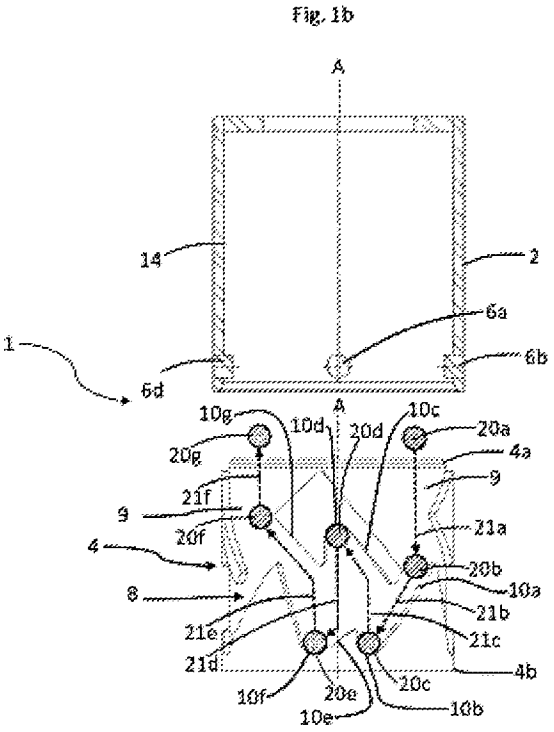
FIG. 1*b* is a cross section view of the quick connector mechanism shown in FIG. 1*a;*

The problems being solved and the solutions provided by the embodiments of the principles of the present inventions are best understood by referring to FIGS. 1 to 12 of the drawings, in which like numbers designate like parts.

Various embodiments of connector 1, 1' are illustrated in FIGS. 1-12. Each connector 1 has a first part 2 and a second part 4, each part 2, 4 having a curved surface which encloses a generally cylindrical volume with a longitudinal axis A. The curved surface of the first part 2 is an interior surface, while the curved surface of the second part 4 is an exterior surface. The diameter of the curved surface of the second part 4 is less than the diameter of the curved surface of the first part 2, so that the second part 4 can be placed inside the first part 4 with the two curved surfaces coaxial but spaced from one another. The first part 2 may be a tube, whilst the second part 4 may be a solid cylinder or a tube.

One of the first part 2 or the second part 4 is provided with a plurality of pins which are spaced around the circumference of and extend radially from the curved surface, either radially outwardly if the curved surface is an exterior surface or radially inwardly of the curved surface is an interior surface. This part will be referred to in the descriptions below of the specific embodiments illustrated in the figures as the engagement part, and the pins as engagement pins. The curved surface of other one of the first part 2 or the second part 4 is provided with at least one indexing channel 8 which extends around at least a portion of the circumference of the curved surface. This part will be referred to in the descriptions below of the specific embodiments illustrated in the figures as the indexing part. The or each indexing channel 8 has a two opposite edges 8*a*, 8*b* and a floor 8*c* which extends between the two edges. The indexing part may be provided with a single indexing channel which extends around the entire circumference of the indexing part. Alternatively, the indexing part may be provided with a plurality of separate indexing channels—one for each engagement pin, each indexing channel extending around a portion of the circumference of the indexing part.

The indexing part 4 has a first end 4*a* and a second end 4*b*, the curved surface extending from the first end 4*a* to the second end 4*b*, and is also provided with a plurality of entry channels 9—one for each pin. Each entry channel 9 extends from the curved surface at the first end 4*a* of the indexing part 4 to the or one of the indexing channel(s) 8, generally parallel to the longitudinal axis A. Each entry channel 9 has two opposite edges and a floor which extends between the two edges. The edges of each entry channel 9 need not extend parallel to the longitudinal axis A, but the entry channel 9 itself provides a path which is parallel to the longitudinal axis A.

The length of the engagement pins 6*a*-6*d* and the depth of the indexing and entry channels 8, 9 are such that the first part 2 can only be placed inside the second part 4, with each of the engagement pins 6*a*-6*d* extending into one of the entry channels, or the or one of the indexing channel(s). The engagement pins 6*a*-6*d* can move along the or each indexing channel 8 when the first part 2 is rotated about the longitudinal axis A as indicated in FIG. 1 by arrow 7*a* relative to the second part 4, but are trapped in the channels 8, 9. The edges 8*a*, 8*b* of the or each indexing channel 8 form a plurality of camming surfaces with which the engagement pins 6*a*-6*d* can engage during rotation of the first part 2 relative to the second part 4. Ideally, the engagement pins 6*a*-6*d* are short enough that there can be a space between the end of each engagement pin 6*a*-6*d* and the indexing part, so that the engagement pins 6*a*-6*d* can move freely along the indexing and entry channels 8, 9 without scraping along the floor of the channels 8, 9. Alternatively, movement of the engagement pins 6*a*-6*b* along the or each indexing channel 8 can occur if the second part 4 rotates in the opposite direction to the first part 2 as indicated by arrow 7*b*.

The entry channels 9 are spaced around the curved surface of the indexing part 4 in the same way as the pins are spaced around the curved surface of the engagement part 2. This means that the first and second parts 2, 4 of the connector 4 may be connected by lining up the engagement pins 6*a*-6*d* with the entry channels 9, moving the engagement pins 6*a*-6*d* along the entry channels 9 as the second part 4 is moved generally parallel to its longitudinal axis A into the first part 2, and then, when the engagement pins 6*a*-6*d* reach the indexing channel 8, rotating the parts 2, 4 about longitudinal axis A relative to one another in a first direction so that the engagement pins 6*a*-6*d* travel along the indexing channel 8. At this point, engagement of the engagement pins 6*a*-6*d* with the first edge 8*a* of the indexing channel 8 ensures that the first and second parts 2, 4 of the connector 1 can no longer be separated by purely translational movement parallel to the longitudinal axis A.

It will be appreciated that it is possible to separate the first and second parts 2,4 by rotating the parts 2,4 relative to one another in a second direction opposite to the first direction to return the engagement pins 6*a*-6*d* to the entry channels 9. The parts 2, 4 can then be separated by relative movement parallel to the longitudinal axis A to move the engagement pins 6*a*-6*d* back along the entry channel 9 along which they travelled when the parts 2,4 were connected. In the embodiments illustrated in the Figures, however, there is a single indexing channel 8 which extends around the entire circumference of the indexing part. As such, it is possible to separate the parts 2, 4, by continuing to rotate the first and second parts 2, 4 relative to one another in the first direction, until the engagement pins 6*a*-6*d* reach the next entry channel 9. The parts 2, 4 can then be separated by relative movement parallel to the longitudinal axis A to move the engagement pins 6*a*-6*d* along the next entry channel 9.

In other embodiments, there may be a plurality of separate indexing channels, one for each engagement pin 6*a*-6*d*. In this case, the indexing part could also be provided with a plurality of exit channels—one for each indexing channel. Each exit channel extends from the indexing channel to the first end of the indexing part generally parallel to the longitudinal axis A. The edges of each exit channel need not extend parallel to the longitudinal axis A, but the exit channel itself provides a path which is parallel to the longitudinal axis A. The entry channel 9 for each indexing channel extends to a first end of its respective indexing channel, and the exit channel for each indexing channel extends to a second opposite end of its respective indexing channel. In this case, it would be possible to separate the parts 2, 4, by continuing to rotate the first and second parts 2, 4 relative to one another in the first direction, until the pins reach the exit channel. The parts 2, 4 can then be separated by relative movement parallel to the longitudinal axis A to move the engagement pins 6*a*-6*d* along the exit channel.

The connector 1 may be used to lift a load by suspending one of the first or second parts from a hoisting apparatus, such as a crane, and securing the other of the first or second parts to the load. The load is arranged so that when it is resting on a support surface, the part secured to the load is typically secured to a generally vertically upward facing surface of the load, so that the hoisting apparatus can be operated to position the other of the first or second parts vertically above the other part, and to lower the part suspended from the hoisting apparatus into engagement with the part secured to the load when the either one or both of the first and second parts must be mounted such that rotation of the part as indicated by arrows 7*a* or 7*b* about its longitudinal axis A is permitted, so that the first and second parts can be connected and disconnected as described above.

The or each indexing channel 8 has two opposite edges—a first edge 8*a* which is closest to the first end 4*a* of the indexing part, and a second edge 8*a* which is furthest from the first end 4*a* of the indexing part. Both of these edges 8*a*, 8*b* extend very generally around the circumference of the curved surface, in the sense that the indexing channel 8 provides a path around at least part of the circumference of the curved surface. The edges 8*a*, 8*b* are not, however, perpendicular to the longitudinal axis A, and follow a relatively convoluted path in which some portions extend towards the first end 4*a* of the indexing part, and other portions extend towards the second end 4*b* of the indexing part. In the description below, when the word opposite is used to describe features of the two edges 8*a*, 8*b* of the indexing channel 8, this refers to portions which both lie on an imaginary line on the curved surface extending parallel to the longitudinal axis A.

In the embodiments in which the indexing part is provided with a single indexing channel 8 which extends around the entire circumference of the curved surface of the indexing part, the indexing channel 8 is divided into a plurality of portions—each portion extending between two adjacent entry channels 9, each portion of the indexing channel 8 is provided with the following features. The second edge 8*b* of each has a first camming surface 10*a* which extends from a portion of the second edge of the indexing channel 8 which is opposite to the entry channel 10 in a first direction around the circumference of the curved surface and towards the second end 4*b* of the indexing part at an angle of between 0° and 90° relative to the longitudinal axis A, to a first rest formation 10*b*. The first rest formation 10*b* includes a portion of the second edge of the indexing channel 8 in which it changes direction, and transitions from extending towards the second end 4*b* of the indexing part to extending towards the first end 4*a* of the indexing part.

The first edge 8*a* of the indexing channel 8 provides a second camming surface 10*c*. The second camming surface 10*c* extends from a portion of the first edge 8*a* of the indexing channel 8 opposite to the first rest formation 10*b* in the first direction around the circumference of the curved surface towards the first end 4*a* of the indexing part, to a second rest formation 10*d*. The second rest formation 10*d* includes a portion of the first edge 8*a* of the indexing channel 8 in which it changes direction, and transitions from extending towards the first end 4*a* of the indexing part to extending towards the second end 4*b* of the indexing part.

The second edge 8*b* of the indexing channel 8 provides a third camming surface 10*e*. The third camming surface 10*e* extends from a portion of the second edge 8*b* of the indexing channel 8 opposite to the second rest formation 10*d* in the first direction around the circumference of the curved surface towards the second end 4*b* of the indexing part, to a third rest formation 10*f*. Just like the first rest formation 10*a*, the third rest formation 10*f* includes a portion of the second edge 8*b* of the indexing channel 8 in which it changes direction, and transitions from extending towards the second end 4*b* of the indexing part to extending towards the first end 4*a* of the indexing part.

The first edge 8*a* of the indexing channel 8 provides a fourth camming surface 10*g*. The fourth camming surface 10*g* extends from a portion of the first edge 8*a* of the indexing channel 8 opposite to the third rest formation 10*f* in the first direction around the circumference of the curved surface towards the first end 4*a* of the indexing part. Where the indexing part is provided with a single indexing channel 8 which extends around the entire circumference of the indexing part, the fourth camming surface 10*g* extends to the next entry channel 9. Where the indexing part is provided with a plurality of indexing channels which each extend around only a portion of the circumference of the indexing part, the fourth camming surface 10*g* extends to the exit channel associated with that indexing channel.

Where the indexing part is provided with a plurality of separate indexing channels 8, each of these separate indexing channels has the camming surfaces and rest formations 10*a*, 10*b*, 10*c*, 10*d*, 10*e*, 10*f*, 10*g* described above.

Figure 1A:
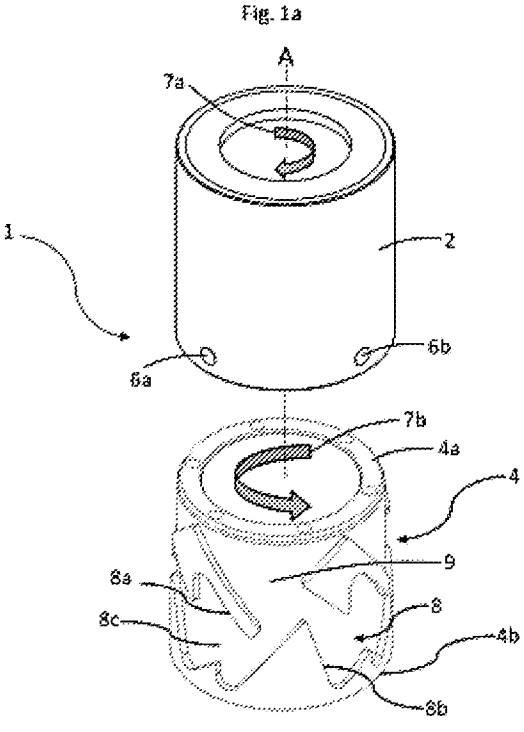
FIG. 1*a* is an isometric view of an embodiment of a quick connector in an exploded view in accordance with the present invention.

FIG. 1*a* is an isometric view of a first embodiment of connector 1 in an exploded view and FIG. 1*b* is a cross section view of the connector 1 shown in FIG. 1*a*. In this embodiment, the first part 2 is the engagement part, and the second part 4 is the indexing part, the engagement part 2 has four engagement pins 6*a* to 6*d*. (6*c* not seen), extending radially inwardly of the curved surface, and the indexing part 4 has a single indexing channel 8 which forms a loop around the entire circumference of the curved surface of the indexing part 4, and four entry channels 9. The engagement pins 6*a*, 6*b*, 6*d* and entry channels 9 are equally spaced around the circumference of the engagement part 2, and indexing part 4 respectively. The indexing channel 8 has four substantially identical portions each of which extends between two adjacent entry channels 9.

In use, in this embodiment, the engagement part 2 would be attached to a hoisting apparatus such as a crane, and the indexing part 4 to a load. Both the engagement part 2 and the indexing part 4 are arranged so that their longitudinal axes A are vertical. The engagement part 2 is suspended from the hoisting apparatus above the indexing part 4 and the indexing part 4 is arranged so that its second end 4*b* is below its first end 4*a*.

To engage the connector 1, the hoisting apparatus is operated to lower the engagement part 2 over the indexing part 4. In this embodiment, when the engagement part 2 is lowered over the indexing part 4, rotation occurs for the engagement part 2 in a clockwise direction 7*a* (looking down from top) or rotation of the indexing part 4 occurs in an anticlockwise direction 7*b*. Normally one part will be fixed and the other will rotate. For example, the engagement part 2 can be connected to the hoisting apparatus in such a way that rotation of the engagement part 2 about longitudinal axis A relative to the hoist apparatus is permitted, and the indexing part 4 fixed. The reverse is, however, possible, as is configuring the connections between the engagement part 2 and the hoisting apparatus and the indexing part 4 and the load so that both parts 2, 4 can rotate about their longitudinal axis A.

Referring to FIG. 1*b*, the actuation pattern and movement is described. For this description the indexing part 4 is stationary and the engagement part 2 is being vertically displaced up and down, forcing the engagement part to rotate clockwise as the engagement pins 6*a*, 6*b*, 6*d* are forced to follow the channels 8, 9 on the indexing part 4. For the purposes of this next discussion engagement pin positions 20*a* to 20*g* show the movement of one of the four engagement pins 6-6*d* on the engagement part 2 along the paths described by the arrows 21*a* to 21*f*. An engagement pin 6*a*-6*d* is situated at position 20*a* meaning the sleeves are disconnected. As the engagement pins 6*a* to 6*d* are equally spaced at 90 degree intervals it means that at the same time all the engagement pins 6*a*-6*d* are in a similar position with the entry channels 9 on the indexing part 4 also being equally spaced 90 degrees apart. As the indexing part 2 is lowered the pins 6*a*-6*d* will travel along one of the entry channels 9 along the path indicated by arrow 21*a* to position 20*b* where it engages with the first camming surface 10*a* of one of the portions of the indexing channel 8. Further lowering will now result in the engagement part 4 rotating clockwise due to the cam action of the first camming surface 10*a* on the engagement pins 6*a*-6*d*, pin 6 travelling to the first rest formation 10*b* at position 20*c* along path indicated by arrow 21*b*. In position 20*c*, the pins 6*a*-6*d* can no longer travel down and this will be seen as a loss in weight on the hoisting apparatus lowering the engagement part 2 or as no further downward movement visually of engagement part 2.

This is stroke one of four: 1. Down, 2. Up "engaged", 3. Down, 4. Up "dis-engaged". Now the hoisting apparatus is operated to raise the engagement part 2 and the pins 6*a*-6*d* move upwards to engage with the second camming surface 10*c*, and with further upward movement of the engagement part 2 the camming action of the second camming surface 10*c* will force the pins 6*a*-6*d* into the second rest formation 10*d* at position 20*d* following path of arrow 21*c*. This is stroke 2. and now the connector 1 is engaged and the hoisting apparatus can be operated to lift the load attached to the indexing part 4. Under load this is a rigid connection—the pins 6*a*-6*d* are held in the second rest formation 10*d* and so no relative rotation of the two sleeves is possible.

Once the load is lifted as desired (the connector may not move if the desire is to test an engagement mechanism rather than a lift), then hoisting apparatus can be operated to lower the engagement part 2 Once the load has been replaced on a supporting surface, further downward movement of the engagement parts 2 will cause pin 6 to travel along path of arrow 21*d* to position 20*e*, where it engages with the third camming surface 10*e*. With further downward movement of the engagement part 2, the camming action of the third camming surface causes rotation clockwise of the engagement part 2. Position 20*e* is similar to position 20*c* in that it is just a downstroke: Stroke 3, Down.

For the final disengagement stroke 4. Up "dis-engagement" the engagement part 2 is lifted and pin 6 will travel along path of arrow 21*e* to the fourth camming surface 10*g* at position rotating engagement part 2 clockwise. From position 20*f* the engagement part 2 will travel vertically with no further rotation as the pin 6 has cleared the fourth camming surface 10 and entered the entry channel 9 at the end of the portion of indexing channel 8. In position 20*g* we are clear of the indexing part 4, and the two parts 2,4 of the connector 1 are separated. During this process, the engagement part 2 has rotated by 90 degrees clockwise about longitudinal axis A. The other engagement pins 6 would have followed similar paths in these cycles.

Figure 2B:
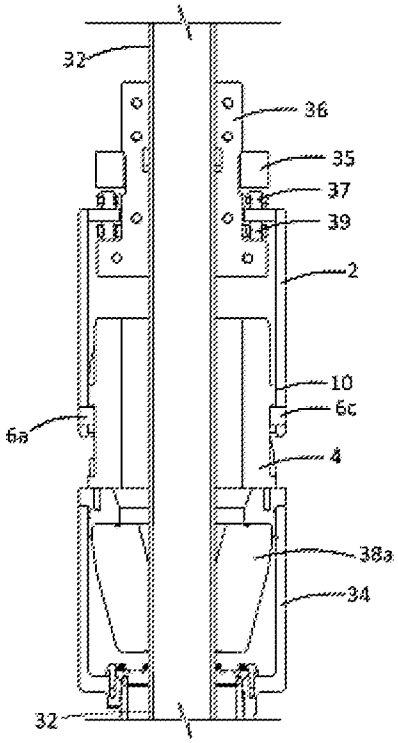
FIG. 2*b* is a cross section detail of the quick connector as attached to the top of the RCD in FIG. 2*a;*
Figure 2A:
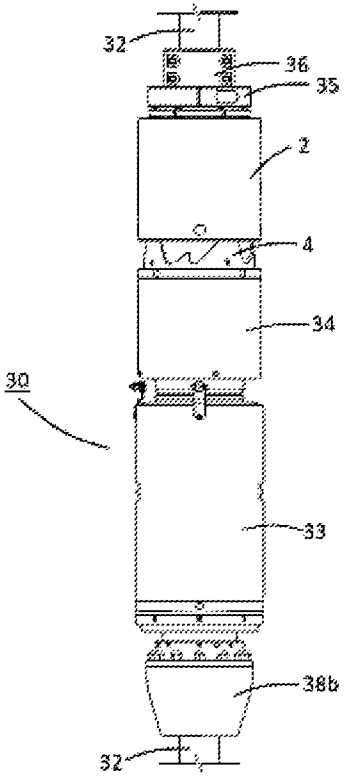
FIG. 2*a* is a side view of an embodiment of the quick connector of FIGS. 1*a-b* for deploying and retrieving a rotating control device (RCD) with drill pipe in accordance with the present invention.

FIG. 2*a* and 2*b* depict an embodiment which shows how the connector 1 illustrated in FIGS. 1*a*-*c* can be used for deploying and retrieving a rotating control device (RCD) with drill pipe. FIG. 2*b* is a cross section detail of the connector 1 as attached to the top of the RCD. Referring to FIG. 2*a* we see the connector 1 including of the engagement part 2 and indexing part 4 is attach to a Rotating Control Head (RCD) assembly 30. The RCD assembly 30 has three main parts: an upper bowl 34 with an elastomeric sealing element 38*a* inside that seals around the drillpipe 32; a bearing assembly 33 and a lower elastomeric sealing element 38*b* that also seals around drill pipe 32.

Focusing more on FIG. 2*b*, the indexing part 4 is rigidly bolted to the upper bowl 34 with its second end 4*b* below its first end 4*a*, and the longitudinal axis A vertical, so the RCD assembly 30 which will be latched in a RCD housing (not shown) will not be rotating. The engagement part 2 is mounted on the drillpipe 32 with a clamp 36 which consist of two halves bolted onto the drillpipe, a secondary clamp 35, and swivel rings 37, 39. The secondary clamp 35 can be removed from the clamp 36 to allow disassembly of the swivel rings 37 and 39. The engagement part 2 is supported on the swivel rings 37 and 39, and these provide a bearing assembly which enables the engagement part 2 to rotate about longitudinal axis A.

The details of the connector 1 are as described above in relation to the embodiment illustrated in FIG. 1*a* and 1*b* and thus vertical reciprocation of the drillpipe 32 will drive the strokes for connecting and disconnecting the RCD assembly typically for deployment and retrieval as required in the way described in relation to FIGS. 1*a*-1*b*.

Figure 3B:
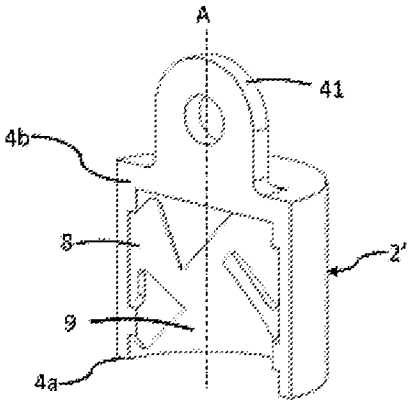
FIG. 3*b* is a half section isometric view of the upper part of quick connector in FIG. 3*a;*
Figure 3C:
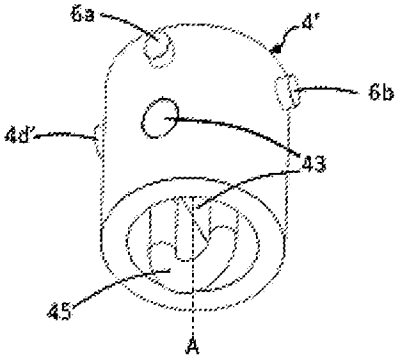
FIG. 3*c* is an isometric view of the lower half of the reversed mechanism of FIGS. 3*a*-3*b;*
Figure 3A:
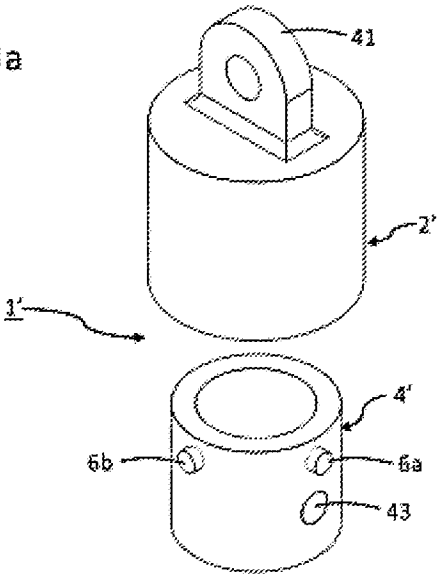
FIG. 3*a* is an isometric view of a second embodiment of a connector with a reversed engagement mechanism in accordance with the present invention.

Referring now to the FIG. 3*a* to 3*b*: FIG. 3*a* is an isometric view of another embodiment of connector 1'. This embodiment has a reverse engagement mechanism; FIG. 3*b* is a half section isometric view of the first part 2' of the connector in FIG. 3*a* and FIG. 3*c* is an isometric view of the second part 4' of the connector 1'. In this embodiment, the engagement mechanism is reversed in that the first part 2' is the indexing part, and the second part 4' is the engagement part. The entry and indexing channels 8,9 are provided on the curved interior surface of the indexing part 2' so that the camming surfaces extend radially inwardly of to the curved surface of the indexing part 2'. The engagement part 4' has four circular engagement pins 6*a*', 6*b*'. The indexing part 2' of this connector 1' is provided with a lifting formation with a pad-eye 41 and the engagement part is provided with a lifting link 45. The engagement part 4' has a load bearing rod 43 which extends across the engagement part 4' and which serves to stiffen the sleeve and transmit the load from the lifting link 45.

Figure 4B:
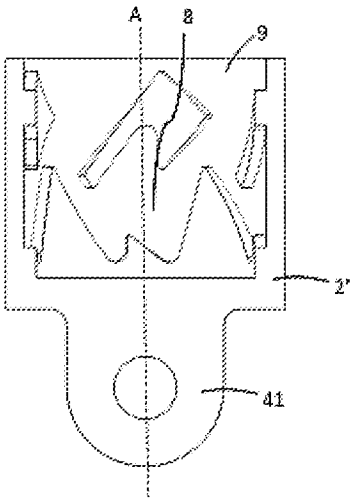
FIG. 4*b* is a cross section of the lower section of assembly in FIG. 4*a;*
Figure 4A:
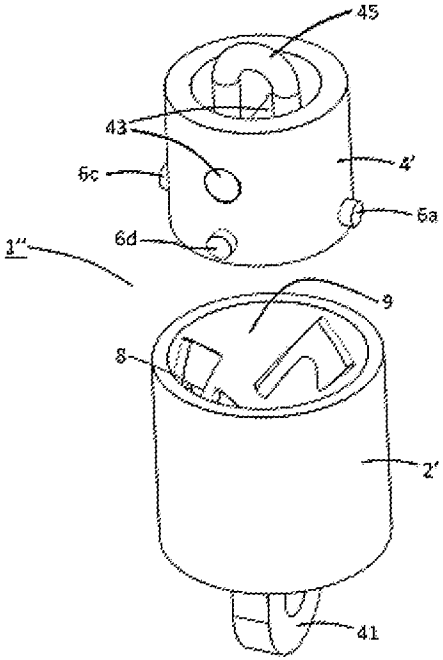
FIG. 4*a* is an isometric view of a third embodiment of a connector with an internal engagement mechanism in accordance with the present invention.

FIG. 4*a* shows an isometric view of the same assembly as in FIG. 3*a* to 3*c* but inverted by 180 degrees. FIG. 4*b* shows a cross-section of the indexing part 2'. This is an example of the internal mechanism with the camming surfaces internal on the indexing part 4' and having the engagement part 4' with four engagement pins 6*a*-6*d*. In this version the lifting link 45 is at the top held by the reinforcing rod 43. The indexing part 2' has an interior curved surface which is provided with the entry and indexing channels 8, 9, and the pad-eye 41. The reason for creating the distinction between the reverse mechanism of FIG. 3*a* to 3*c* and the internal mechanism of FIG. 4*a* and 4*b* is that for some applications it may be advantageous to have the design either way for purposes of affixing the lower part to a common part as will be illustrated in FIG. 5*a* and 5*b*.

Figure 5B:
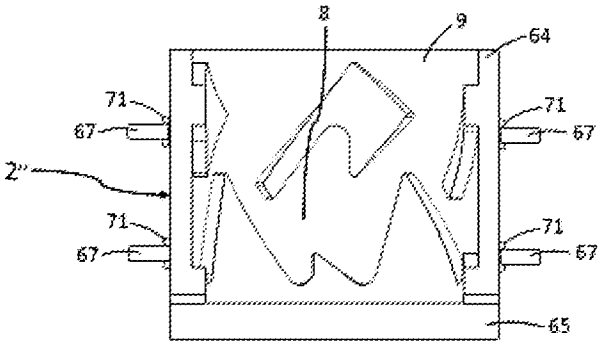
FIG. 5*b* is another embodiment of the lower half of a quick connector shown as a cross section.
Figure 5A:
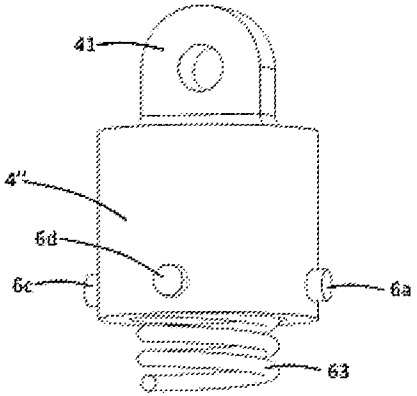
FIG. 5*a* is a fourth embodiment of the upper half of a quick connector with internal engagement mechanism in accordance with the present invention.

FIG. 5*a* and 5*b* show a further embodiment of connector 1" with an internal mechanism with some enhancements. In this embodiment, the second part is the engagement part 4" with four external engagement pins 6*a*-6*d*. This engagement part 4" has an internal spring 63 which extends from an opposite end of the engagement part 4" to the pad eye 41. The first part is the corresponding indexing part 2" "4 with the entry and indexing channels 8,9 provided on an inner surface thereof. The indexing part 2" has a solid bottom plate 65 against which the spring 63 can react when the connector 1" is assembled. The indexing part 2" has several installation pins 67 welded to the exterior surface thereof with the welding beads 71. These pins 67 can act as holders for installing the indexing part 2" in cast concrete during manufacturing. More detail on this in FIG. 6*a* and 6*b*.

Figures 6A, 6B, 6C, 6D:
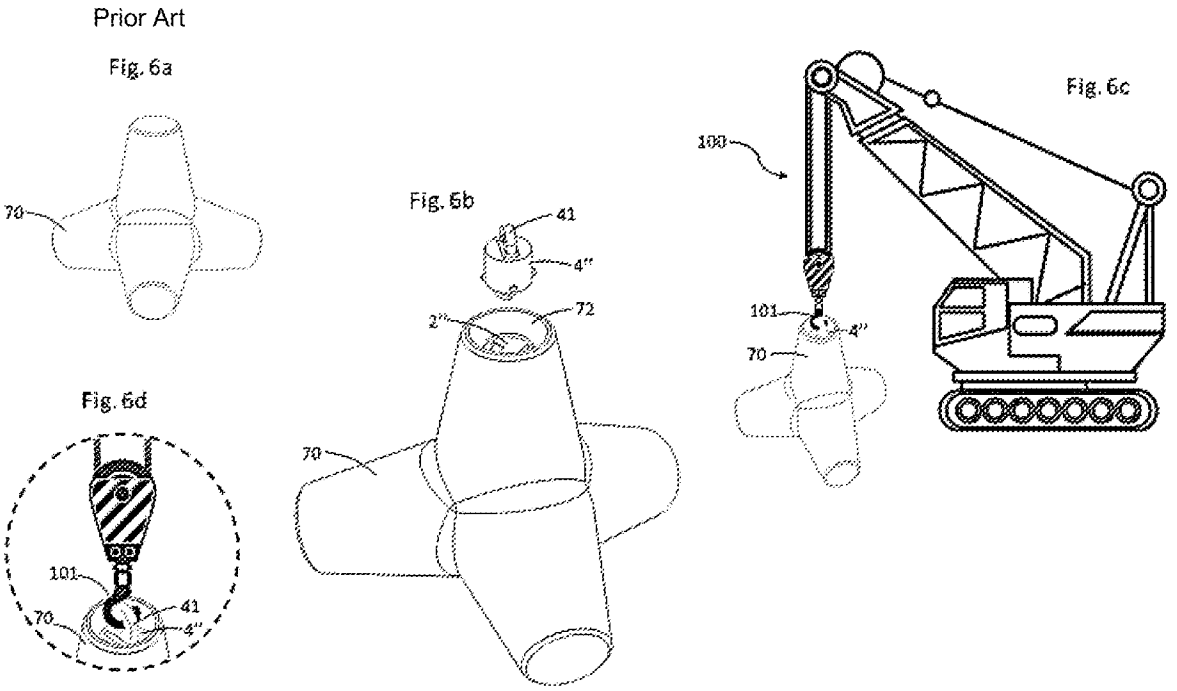
Prior Art Fig. 6a
FIG. 6*a* is an isometric view of a known tetrapod for breakwater construction.
FIG. 6*b* is an isometric view of an embodiment of a tetrapod modified with an internal connector lifting mechanism of FIGS. 5*a-b* in accordance with the present invention.
FIG. 6*c* shows a crawling crane (hoist) about to engage the modified tetrapod of FIG. 6*b;*
FIG. 6*d* shows the detailed engagement of the hoist with the tetrapod of FIG. 6*b;*

FIG. 6*a* shows a concrete tetrapod 70 that is made from cast concrete. Many of these in their hundreds and thousands are used for breakwater construction or for preventing erosion of exposed coastlines. Typically, they do not have a proper lifting system, the norm being to use slings around the legs or sometime they will have a hole through some part for passing a sling. They are usually installed by crane and the unshackling of a tetrapod placed on top of other tetrapods is a risky human operation as it is not even ground and tetrapods can move. Installing a connector 1" as described in FIG. 5*a*. and 5*b* creates a much safer lifting system. The indexing part 2" can be cast as part of the tetrapod 70 being solidly attached to it by the pins 67 (FIG. 5*b*). A guiding funnel 72 can be part of the design—the guiding funnel tapering inwards towards the first end of the engagement part 4" and including guide formations which guide the engagement pins 6*a*-6*d* into the entry channels 9 as the engagement part 4" is lowered towards the indexing part 2".

In FIG. 6*c* we have a hoisting apparatus, which in this embodiment is a crawling crane (hoist) 100 as is typically used for tetrapod installations. The engagement part 4" can be attached to the crane hook 101 that can be lowered to engage the indexing part 4" being guided by the funnel 72 as a completely person-less procedure. See detail in FIG. 6*d*. The spring 63 (FIG. 5*a*) on the engagement part 4" can be compressed by lowering the hook weight on top of the engagement part 4". The tetrapod 70 can now be lifted into position and by cycling the connector 1" will disengage, with the spring 63 acting as an aid should the crane hoist not be perfectly aligned, also making this a person-less and much safer operation.

Figure 7B:
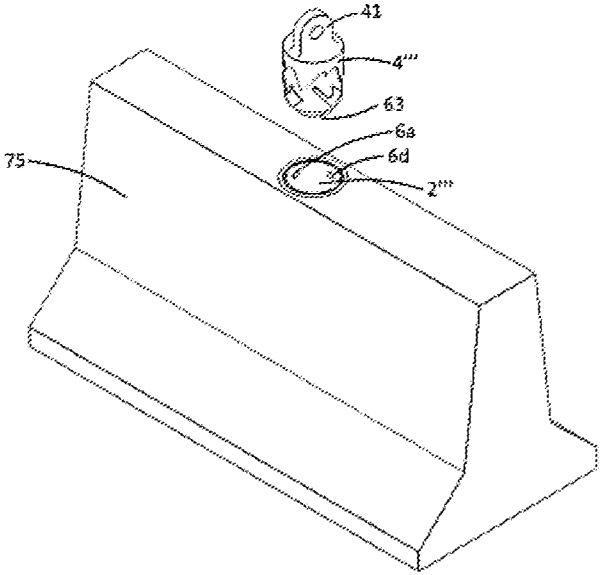
FIG. 7*b* is an isometric view of a concrete block lane separator with the inverted standard mechanism version of the quick connector of FIG. 7*a;*
Figure 7A:
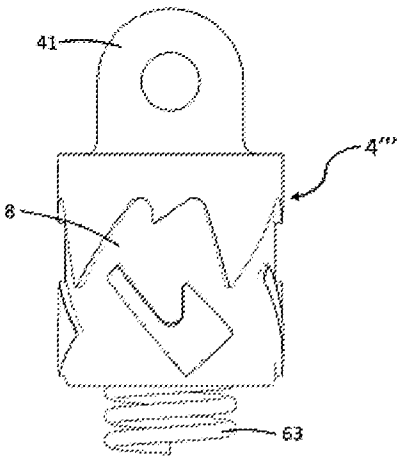
FIG. 7*a* is a side view of the top part of a fifth embodiment of a connector designed as an inverted version of the standard version described in FIG. 1*a* and 1*b* in accordance with the present invention.

FIG. 7*a* shows a side view of an upper external indexing part 4''', which is a 180 degree inverted version of the embodiment illustrated in FIG. 1*a* and 1*b*. The indexing part 4''' has a lifting pad-eye 41 and a release spring 63 as part of the design. An application of this embodiment is shown in FIG. 7*b* for lifting a concrete roadside block 75. Here the engagement sleeve 2''' with internal engagement pins 6*a*-6*d* is installed during the casting of the block 75. This may be preferential for this application as the upper external indexing part 4''' with the machined indexing and entry channels may be the more expensive part and stays with the hoist or crane, whilst the cheaper to manufacture engagement part 2''' is permanently installed in many concrete roadside blocks 75.

Figure 8A:
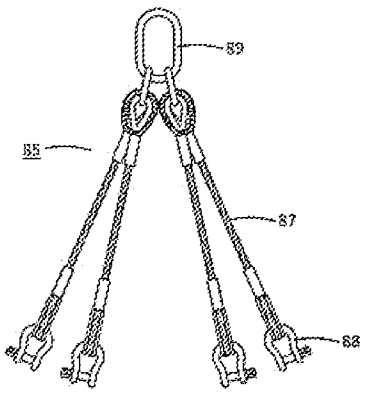
Prior Art Fig.8a
FIG. 8*a* is a side view of a known four-point lifting sling system.

Another application of the quick connector is now discussed. FIG. 8*a* shows a version of a 4-point lifting sling system 85 as is commonly used for lifting baskets and containers. It has a lifting link 89 that is attached to a crane hook or hoist. The bottom of the ring 89 is connected to four equal length slings 87 and these have shackles 88 that are attached to the load.

Figure 8B:
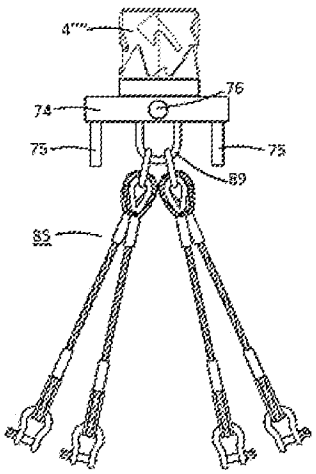
FIG. 8*b* is side view of a modified four-point sling system with a lower portion of a sixth embodiment of a connector lifting mechanism incorporated in accordance with the present invention.
Figure 8C:
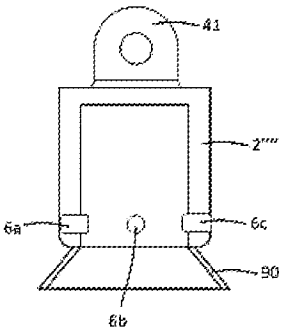
FIG. 8*c* is a cross section of the upper part of the connector lifting mechanism of FIG. 8*b* with a funnel engagement in accordance with the present invention.

FIG. 8*b* is side view of a modified four-point sling system with the indexing part of the connector 1 incorporated. It has the same mechanism as illustrated in FIG. 1*a* and 1*b* with an external indexing sleeve 4'''' attached to a circular plate ring 74 that has a lifting rod 76 passing through that is permanently engaged with link 89 of the 4-point lifting system 85. The plate ring 74 has at least three legs 75 that serve to hold the upper sleeve vertically aligned when the legs are sitting on a flat surface like the ground or on, the top of a shipping container. FIG. 8*c* shows a cross section of the engagement part 2'''' of the connector 1 with four engagement pins 6*a*-6*d* and a lifting pad-eye 41. It has a funnel guide 90 attached to the bottom.

Using the connector as shown in FIG. 8*b* and 8*c*, the assembly of FIG. 8*b* can be installed permanently on a working container or basket used for offshore service work. Typically, the loading and unloading of such containers and baskets from or to an offshore supply vessel is a very risky operation with significant movement due to heave caused by seas. With the engagement part 2'''' installed on a crane hook it is easy to lower the engagement part 2'''' onto the indexing part 4'''' guided by the funnel 90 without human intervention. Then the load can be lifted and after setting down and cycling the connector, disengaged without human intervention. Thus, the quick connector enables fast and safe lifting operations without direct human intervention.

Figure 9B:
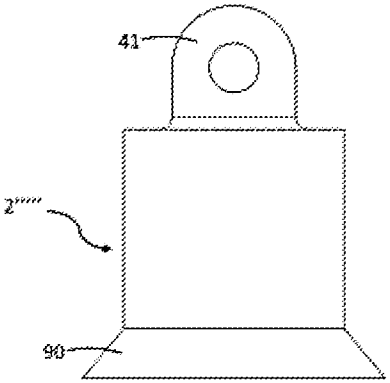
FIG. 9*b* is a side view of the upper part of the connector version shown in FIG. 9*a;*
Figure 9A:
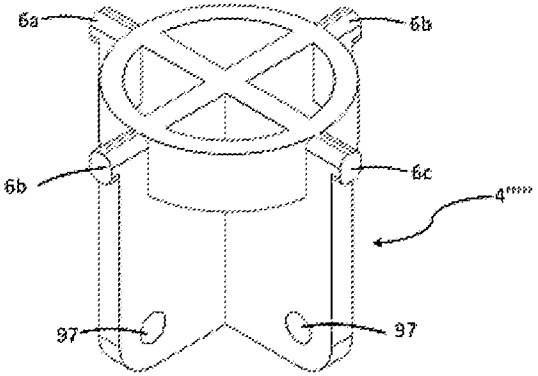
FIG. 9*a* is an isometric view of the lower part of a seventh embodiment of a connector with a reverse mechanism for a four-point lifting sling system.

FIG. 9*a* and 9*b* show another embodiment of connector that can be adapted for a 4-point lifting system. An isometric view of the engagement part 4''' of the connector with a reverse mechanism is shown in FIG. 9*a*. It has four engagement pins 6*a*-6*d* and four holes 97 for attaching the lifting slings by shackles (not shown). FIG. 9*b* shows a side view of the upper inner indexing part 2''''' which has a funnel guide 90 and a lifting pad-eye 41. Thus, depending on the detail of the 4-point lifting application either a standard or reverse mechanism of the quick connector may be designed.

Figure 10B:
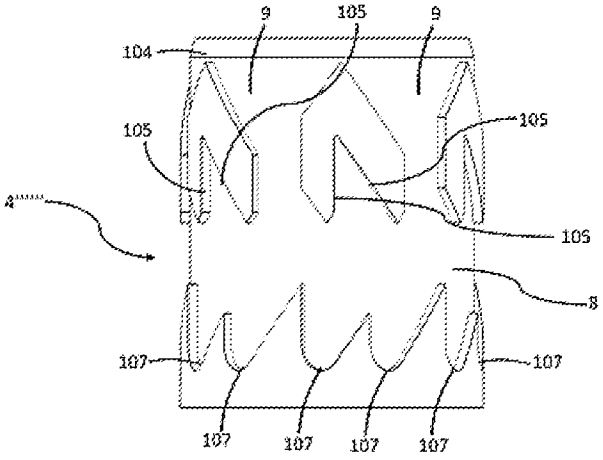
FIG. 10*b* is a side view of the matching bottom part of the embodiment of the connector shown in FIG. 10*a;*
Figure 10A:
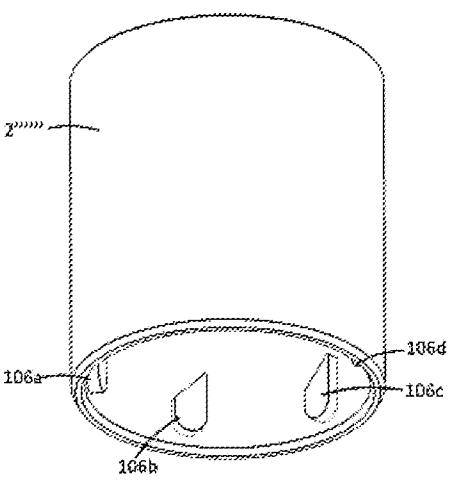
FIG. 10*a* shows an isometric view of an upper part of an eighth embodiment of a connector, with 6 engagement pins that are of a modified shape in accordance with the present invention.

The embodiment of the connector shown in FIG. 10*a* and 10*b* serves to illustrate the versatility of the design. A standard mechanism is shown with an upper internal engagement part 2'. In this case the engagement part 2' has six engagement pins (106*a*-106*d* are visible in the figures) that are triangular at the top and round on the bottom. The edges of the indexing channel 8 of the corresponding indexing part 4''''' have matching cam surfaces 105 for the upper part of the pins and cam surfaces 107 for the lower part of the pins. In this embodiment it will be appreciated that as there are six engagement pins 106*a*-106*d*, there are six entry channels 9, and six portions of the indexing channel each with four camming surfaces 105, and eight camming surfaces 107.

Figures 11A, 11B, 11C, 11D, 11E, 11F, 11G, 11H:
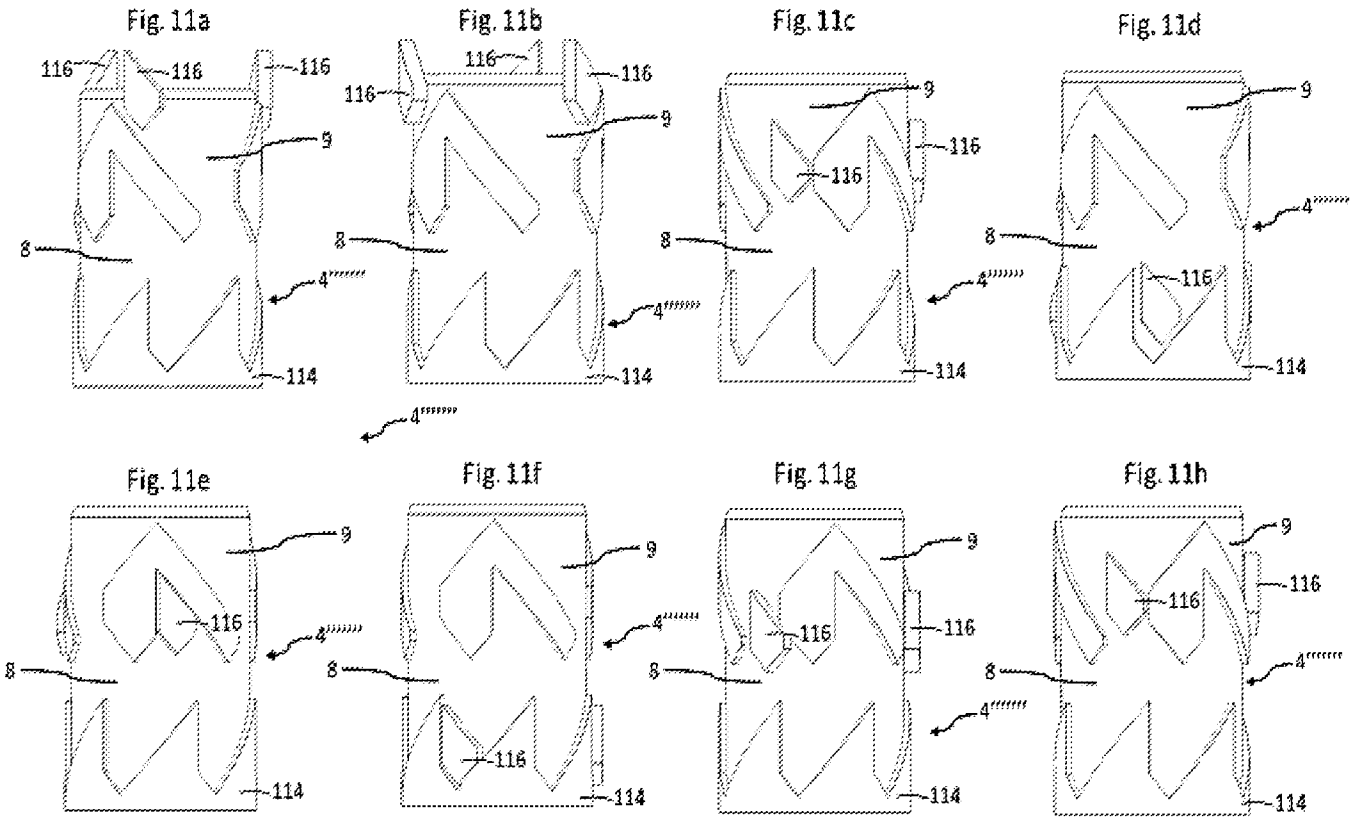
FIG. 11*a* to 11*h* show the movement sequence schematically in side view of a complex polygon engagement pin moving on corresponding slots for such an embodiment.

FIG. 11*a* to 11*h* show the movement sequence schematically in side view of an alternative embodiment of connector in which the engagement part is provided with complex polygon engagement pins 116. These figures show the engagement pins 116 moving along the corresponding entry and indexing channels of a corresponding indexing part 4''''''. The mechanism uses four such engagement pins 116. In this embodiment, the edges of the entry channels 9 can act as camming surfaces which ensure that for any starting alignment the pins 116 will find an entry position as shown in FIG. 11*c*. Even though the rotation of the lower sleeve 114 is clockwise as the pins 116 reciprocate up and down, there may be an initial anti-clockwise movement of sleeve 114 for the engagement position shown in FIG. 11*a*. FIG. 11*c* shows the pins 116 moving down and in FIG. 11*d* they are almost at the bottom of the down stroke. Then FIG. 11*e* shows the completed upstroke engaged and able to lift. FIG. 11*f* shows the completed downstroke and in FIG. 11*g* the pins 116 are being driven by the cams to the exit and finally in FIG. 11*f* the pins 116 are able to exit continuing to move up until the quick connector is disengaged.

Figure 12B:
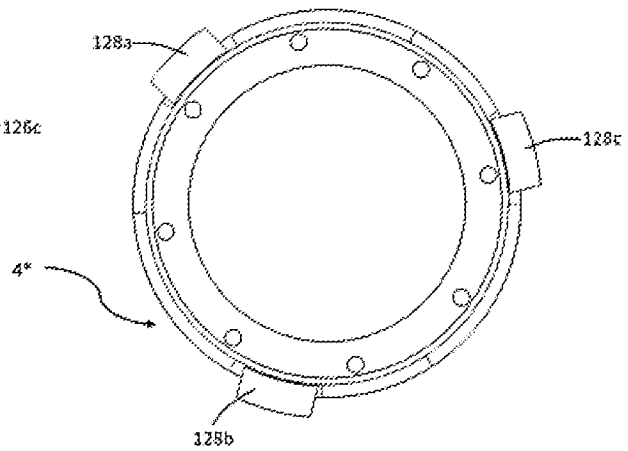
FIG. 12*b* shows a top view of the bottom half of the embodiment of the quick connector of FIG. 12*a* with only three engagement pins having a concave inner surface.
Figure 12A:
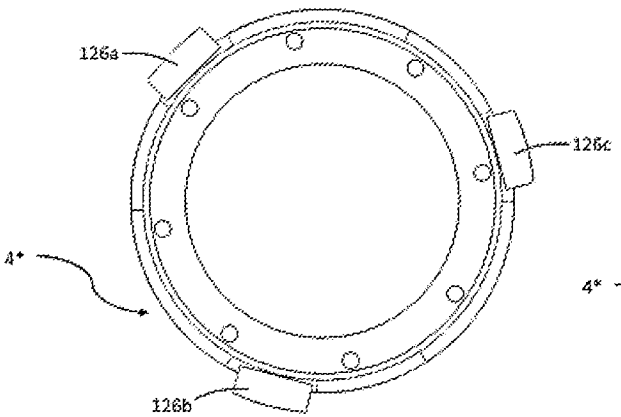
FIG. 12*a* shows a top view of the bottom half of a tenth embodiment of a connector with only three engagement pins having a flat surface in accordance with the present invention.

FIG. 12*a* shows a top view of the lower external indexing part 4* of an embodiment of the connector with three engagement pins 126*a*, 126*b*, 126*c* having a flat surface. The engagement pins 1226*a*-126*c* are shown without the rest of the engagement part, and located at an entry channel of the corresponding indexing part. As the engagement pins 126*a*-126*c* are load bearing it makes sense to have their inside face with the same radius as the riding surface of the indexing part. This improvement in design is shown in FIG. 12*b* with the engagement pins 128*a*-128*c* having a concave inner face. Although it would be possible to design a connector with a single or two engagement pins 128, this would not be self-centering due to the physics and usually the minimum number of enragement pins would be at least three.

It can be seen from the embodiments described above that the connector can be configured such that the first part is the engagement part, and the second part is the indexing part (as illustrated in FIGS. 1*a*, 1*b*, 2*a*, 2*b*, 7*a*, 7*b*, 8*b*, 8*c*, 10*a*, 11$_a$-11*h*), or such that the first part is the indexing part and the second part is the engagement part (as illustrated in FIGS. 3*a*-3*c*, 4*a*, 4*b*, 5*a*, 5*b*, 6*a*, 6*b*, 9*a*, and 9*b*). Moreover, the engagement part can be attached to the hoisting apparatus and the indexing part to the load (as illustrated in FIGS. 2*a*, 2*b*, 6*a*, 6*b*, 8*b*, 8*c*) or the indexing part attached to the hoisting apparatus and the engagement part to the load (as illustrated in FIGS. 7*a*, 7*b*). Where the indexing part is secured to the load, the indexing part is arranged so that its first end is uppermost (so that the engagement pins can be lowered into the entry channels), and when the indexing part is suspended from the hoisting apparatus, the indexing part is arranged so that its first end is lowermost (so that the engagement pins can enter the entry channels as the indexing part is lowered). Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention.

For example, it should be appreciated that the camming surfaces could be configured to cause anticlockwise or clockwise rotation of one or both of the first or second parts of the connector. Whilst in most of the embodiments described above, four engagement pins are provided, this need not be the case, and more or fewer engagement pins (and associated entry channels) could be provided. Providing a larger diameter engagement part will allow for the provision of a greater number of engagement pins. Moreover, as described above, the first and/or second parts of the connector could rotate through a quarter turn (90°) during the process of engagement and disengagement of the two parts of the connector (as facilitated by the up and down strokes of the hoisting apparatus), this need not be the case. This angle could be decreased, by the provision of more than four engagement pins, or by providing exit channels which are radially spaced from the corresponding entry channel by an angle of less than 90°. The engagement pins can be generally cylindrical, as shown in the Figures, but this need not be the case. An end surface of each engagement pin (the end surface being closest to/or in engagement with the indexing part when the indexing and engagement parts are connected could be flat or it could be concave or convex to conform to the curved surface of the indexing part (convex where the indexing part is the first part—i.e., the indexing channel provided on an interior surface, concave where the indexing part is the second part—i.e., the indexing channel provided on an exterior surface).

It is therefore contemplated that the claims will cover any such modifications or embodiments that fall within the scope of the invention.

We claim:

1. A hoisting system comprising:

a hoisting apparatus which is operable to lift a concrete load; and a connector by which the load can be releasably connected to the hoisting apparatus, the connector comprising:

a first part and a second part, one of which is suspended from the hoisting apparatus and the other of which configured to be secured to the concrete load by being embedded in the concrete load, wherein the first part comprises a curved surface that encloses a generally cylindrical volume with a longitudinal axis, and the second part comprises a curved surface that encloses the generally cylindrical volume with the longitudinal axis, the curved surface of the first part being an interior surface, and the curved surface of the second part being an exterior surface, and a diameter of the curved surface of the second part being less than a diameter of the curved surface of the first part, so that the second part can be placed inside the first part with the curved surface of the first part and the curved surface of the second part being coaxial but spaced from one another, wherein one of the first part or the second part is provided with a plurality of pins which are spaced around a circumference of and extend radially from the curved surface of the one of the first part or the second part, and the curved surface of an other one of the first part or the second part is provided with at least one indexing channel which extends around at least a portion of the circumference of the curved surface of the other one of the first part or the second part and a plurality of entry channels-one for each pin, each of the plurality of entry channels extending from the curved surface of the other one of the first part or the second part at a first end of the curved surface of the other one of the first part or the second part on which the entry channel is provided to one or more of the at least one indexing channel.

2. A hoisting system comprising:

a hoisting apparatus which is operable to lift a load; and a connector by which the load can be releasably connected to the hoisting apparatus, the connector comprising:

a first part and a second part, one of which is suspended from the hoisting apparatus and the other of which configured to be secured to the load, wherein the first part comprises a curved surface that encloses a generally cylindrical volume with a longitudinal axis, and the second part comprises a curved surface that encloses the generally cylindrical volume with the longitudinal axis, the curved surface of the first part being an interior surface, and the curved surface of the second part being an exterior surface, and a diameter of the curved surface of the second part being less than a diameter of the curved surface of the first part, so that the second part can be placed inside the first part with the curved surface of the first part and the curved surface of the second part being coaxial but spaced from one another, wherein one of the first part or the second part is provided with a plurality of pins which are spaced around a circumference of and extend radially from the curved surface of the one of the first part or the second part, and the curved surface of an other one of the first part or the second part is provided with at least one indexing channel which extends around at least a portion of the circumference of the curved surface of the other one of the first part or the second part and a plurality of entry channels—one for each pin, each of the plurality of entry channels extending from the curved surface of the other one of the first part or the second part at a first end of the curved surface of the other one of the first part or the second part on which the entry channel is provided to one or more of the at least one indexing channel;

wherein whichever one of the first part or the second part is connected to the load with a connection which is configured to permit the respective first part or the second part to rotate relative to the load.

3. The hoisting system according to claim 2, wherein the curved surface of whichever of the first part or the second part is provided with the plurality of entry channels has a second end, the curved surface extending from the first end to the second end.

4. The hoisting system according to claim 3, wherein if whichever of the first part or the second part is provided with the plurality of entry channels is suspended from the hoisting apparatus, the first end is below the second end.

5. The hoisting system according to claim 3, wherein whichever of the first part or the second part is provided with the plurality of entry channels is secured to the load, and the load and the respective first part or the second part of the connector are arranged such that the first end is vertically above the second end.

6. The hoisting system according to claim 2, wherein a length of the pins and a depth of the at least one indexing channel and the plurality of entry channels are such that the second part can only be placed inside or removed from the first part when each of the plurality of pins extends into one of the plurality of entry channels, or one or more of the at least one indexing channel.

7. The hoisting system according to claim 2, wherein an angle between adjacent ones of the plurality of entry channels is identical with an angle between adjacent ones of the plurality of pins.

8. The hoisting system according to claim 2, wherein the or each of the at least one indexing channel has a first edge and a second edge, the first edge and the second edge of the or each of the at least one indexing channel form a plurality of camming surfaces each of which are inclined relative to the longitudinal axis at an angle of less than 90°.

9. The hoisting system according to claim 8, wherein the curved surface of whichever of the first part or the second part is provided with the at least one indexing channel has a second end, the curved surface extending from the first end to the second end, the first edge of the or each of the at least one indexing channel being closer to the first end of the curved surface on which the first edge is provided than the second edge, and wherein the first edge is configured to form the plurality of camming surfaces of the first edge which extend towards the first end when moving in a first direction around a circumference of the curved surface, and the second edge of the or each of the at least one indexing channel is configured to form a plurality of camming surfaces of the second edge which extend towards the second end when moving in the first direction around the circumference of the curved surface.

10. The hoisting system according to claim 8, wherein the curved surface of whichever of the first part or the second part is provided with the at least one indexing channel has a second end, the curved surface extending from the first end to the second end, the first edge of the or each of the at least one indexing channel being closer to the first end of the curved surface on which the first edge is provided than the second edge, wherein the first edge of the at least one indexing channel is provided with a rest formation where the first edge transitions from extending towards the first end to extending towards the second end.

11. The hoisting system according to claim 8, wherein the curved surface of whichever of the first part or the second part is provided with the at least one indexing channel has a second end, the curved surface extending from the first end to the second end, the first edge of the or each of the at least one indexing channel being closer to the first end of the curved surface on which the first edge is provided than the second edge, wherein the second edge of the at least one indexing channel is provided with a rest formation where the second edge transitions from extending towards the second end to extending towards the first end.

12. The hoisting system according to claim 2, wherein the connector is provided with a single indexing channel which extends in a loop around an entire circumference of whichever of the first part or the second part on which the indexing channel is provided.

13. The hoisting system according to claim 2, further comprising a plurality of flexible cables which are connected to whichever of the first part or the second part of the connector is configured to be secured to the load, and which are provided with a releasable attachment part by which the plurality of flexible cables can be secured to the load.

14. A method of operating a hoisting system to lift a load, wherein the hoisting system comprises:

a hoisting apparatus which is operable to lift a load; and a connector by which the load can be releasably connected to the hoisting apparatus, the connector comprising:

a first part and a second part, one of which is suspended from the hoisting apparatus and the other of which configured to be secured to the load, wherein the first part comprises a curved surface that encloses a generally cylindrical volume with a longitudinal axis, and the second part comprises a curved surface that encloses the generally cylindrical volume with the longitudinal axis, the curved surface of the first part being an interior surface, and the curved surface of the second part being an exterior surface, and a diameter of the curved surface of the second part being less than a diameter of the curved surface of the first part, so that the second part can be placed inside the first part with the curved surface of the first part and the curved surface of the second part being coaxial but spaced from one another, wherein one of the first part or the second part is provided with a plurality of pins which are spaced around a circumference of and extend radially from the curved surface of the one of the first part or the second part, and the curved surface of an other one of the first part or the second part is provided with at least one indexing channel which extends around at least a portion of the circumference of the curved surface of the other one of the first part or the second part and a plurality of entry channels-one for each pin, each of the plurality of entry channels extending from the curved surface of the other one of the first part or the second part at a first end of the curved surface of the other one of the first part or the second part on which the entry channel is provided to one or more of the at least one indexing channel;

the method comprising securing whichever of the first or second parts of the connector is not suspended from the hoisting apparatus to the load, and operating the hoisting apparatus to:

a) suspend whichever part of the connector is suspended from the hoisting apparatus vertically above the other part of the connector, b) move whichever part of the connector is suspended from the hoisting apparatus downwardly so that the second part of the connector enters the first part of the connector and the two parts of the connector are connected, c) move whichever part of the connector is suspended from the hoisting apparatus upwardly to lift the load, d) move whichever part of the connector is suspended from the hoisting apparatus downwardly until the load comes to rest on a supporting surface, e) move whichever part of the connector is suspended from the hoisting apparatus downwardly and then upwardly to disconnect and separate the two parts of the connector.

15. The method of operating a hoisting system according to claim 14, wherein one or both of the first part and the second part of the connector are mounted on the hoisting apparatus or the load such that the first part and/or the second part can rotate about its longitudinal axis relative to the hoisting apparatus or the load, the or each of the at least one indexing channel has a first edge and a second edge, the first edge being closer to the first end of the curved surface than the second edge, and the method comprises, during process b) engaging the plurality of pins with a camming surface provided on the second edge of the or one of the at least one indexing channel so that engagement of the plurality of pins with the camming surfaces causes one or both of the first part and/or the second parts to rotate about its longitudinal axis.

16. The method of operating a hoisting system according to claim 15, wherein the method additionally comprises, during process c), engaging the plurality of pins with a second camming surface provided on the first edge of the or one of the at least one indexing channel so that engagement of the plurality of pins with the first camming surfaces and the second camming surfaces causes one or both of the first part and/or the second part to rotate about its longitudinal axis.

17. The method of operating a hoisting system according to claim 16, wherein the method additionally comprises, during process e), during the downward movement, engaging the plurality of pins with the camming surface provided on the second edge of the or one of the at least one indexing channel so that engagement of the plurality of pins with the camming surface and the second camming surface causes one or both of the first part and/or the second part to rotate about its longitudinal axis.

18. The method of operating a hoisting system according to claim 17, wherein the method additionally comprises, during process e), during the upward movement, engaging the plurality of pins with the second camming surface provided on the first edge of the or one of the at least one indexing channel so that engagement of the plurality of pins with the camming surface and the second camming surface causes one or both of the first part and/or the second part to rotate about its longitudinal axis.

19. A method of lifting a load using a hoisting system wherein the load is a block, wherein the hoisting system comprises:

a hoisting apparatus which is operable to lift a load; and a connector by which the load can be releasably connected to the hoisting apparatus, the connector comprising:

a first part and a second part, one of which is suspended from the hoisting apparatus and the other of which configured to be secured to the load, wherein the first part comprises a curved surface that encloses a generally cylindrical volume with a longitudinal axis, and the second part comprises a curved surface that encloses the generally cylindrical volume with the longitudinal axis, the curved surface of the first part being an interior surface, and the curved surface of the second part being an exterior surface, and a diameter of the curved surface of the second part being less than a diameter of the curved surface of the first part, so that the second part can be placed inside the first part with the curved surface of the first part and the curved surface of the second part being coaxial but spaced from one another, wherein one of the first part or the second part is provided with a plurality of pins which are spaced around a circumference of and extend radially from the curved surface of the one of the first part or the second part, and the curved surface of an other one of the first part or the second part is provided with at least one indexing channel which extends around at least a portion of the circumference of the curved surface of the other one of the first part or the second part and a plurality of entry channels-one for each pin, each of the plurality of entry channels extending from the curved surface of the other one of the first part or the second part at a first end of the curved surface of the other one of the first part or the second part on which the entry channel is provided to one or more of the at least one indexing channel;

the first part of the connector is embedded in the block, and the second part of the connector is suspended from the hoisting apparatus operating the hoisting apparatus to:

a) suspend the second part of the connector vertically above the first part of the connector, b) move the second part of the connector downwardly so that the second part enters the first part of the connector and the two parts of the connector are connected, c) move the second part of the connector upwardly to lift the load, d) move the second part of the connector downwardly until the load comes to rest on a supporting surface, e) move the second part of the connector downwardly and then upwardly to disconnect and separate the two parts of the connector.

20. A method of landing a tool in or on a wellbore using a hoisting system, wherein the hoisting system comprises:

a hoisting apparatus which is operable to lift a load; and a connector by which the load can be releasably connected to the hoisting apparatus, the connector comprising:

a first part and a second part, one of which is suspended from the hoisting apparatus and the other of which configured to be secured to the load, wherein the first part comprises a curved surface that encloses a generally cylindrical volume with a longitudinal axis, and the second part comprises a curved surface that encloses the generally cylindrical volume with the longitudinal axis, the curved surface of the first part being an interior surface, and the curved surface of the second part being an exterior surface, and a diameter of the curved surface of the second part being less than a diameter of the curved surface of the first part, so that the second part can be placed inside the first part with the curved surface of the first part and the curved surface of the second part being coaxial but spaced from one another, wherein one of the first part or the second part is provided with a plurality of pins which are spaced around a circumference of and extend radially from the curved surface of the one of the first part or the second part, and the curved surface of an other one of the first part or the second part is provided with at least one indexing channel which extends around at least a portion of the circumference of the curved surface of the other one of the first part or the second part and a plurality of entry channels-one for each pin, each of the plurality of entry channels extending from the curved surface of the other one of the first part or the second part at a first end of the curved surface of the other one of the first part or the second part on which the entry channel is provided to one or more of the at least one indexing channel;

wherein the first part of the connector is mounted around a tubular suspended from the hoisting apparatus, and the second part of the connector is mounted on the tool, and operating the hoisting apparatus to:

a) suspend the first part of the connector vertically above the second part of the connector, b) move the tubular and the first part of the connector downwardly so that the second part of the connector enters the first part and the two parts of the connector are connected, c) move the tubular upwardly to lift the tool, d) move the tubular downwardly until the tool comes to rest on a landing formation in or on the wellbore, e) move the tubular downwardly and then upwardly to disconnect and separate the two parts of the connector.

* * * * *